United States Patent [19]

Jardine et al.

[11] 4,446,114

[45] May 1, 1984

[54] METHOD OF INCREASING THE STRIP COEFFICIENT OF THE STRIP SOLUTION STREAM IN A REDUCTIVE STRIPPING URANIUM RECOVERY OPERATION

[75] Inventors: Kenneth J. Jardine; Robert A. Holleman, both of Lakeland, Fla.

[73] Assignee: Wyoming Mineral Corporation, Lakewood, Colo.

[21] Appl. No.: 279,930

[22] Filed: Jul. 2, 1981

[51] Int. Cl.[3] ..... C01G 43/00

[52] U.S. Cl. ..... 423/10; 423/8

[58] Field of Search ..... 423/8–10

[56] References Cited

U.S. PATENT DOCUMENTS

| | | | |
|---|---|---|---|
| 2,859,092 | 11/1958 | Bailes et al. | 423/18 |
| 2,859,094 | 11/1958 | Schmitt et al. | 423/10 |
| 2,882,123 | 4/1959 | Long | 423/18 |
| 3,711,591 | 1/1973 | Hurst et al. | 423/10 |
| 4,105,741 | 8/1978 | Wiewiorowski et al. | 423/10 |
| 4,207,294 | 6/1980 | Hirono | 423/10 |

*Primary Examiner*—Edward A. Miller

*Attorney, Agent, or Firm*—D. P. Cillo

[57] ABSTRACT

Increasing the strip coefficient of a strip solution stream in a reductive stripping uranium recovery process involving wet process phosphoric acid feed is accomplished by adding effective amounts of $H_2SO_4$ to the strip solution stream before it exits the reductive stripping means.

11 Claims, 1 Drawing Figure

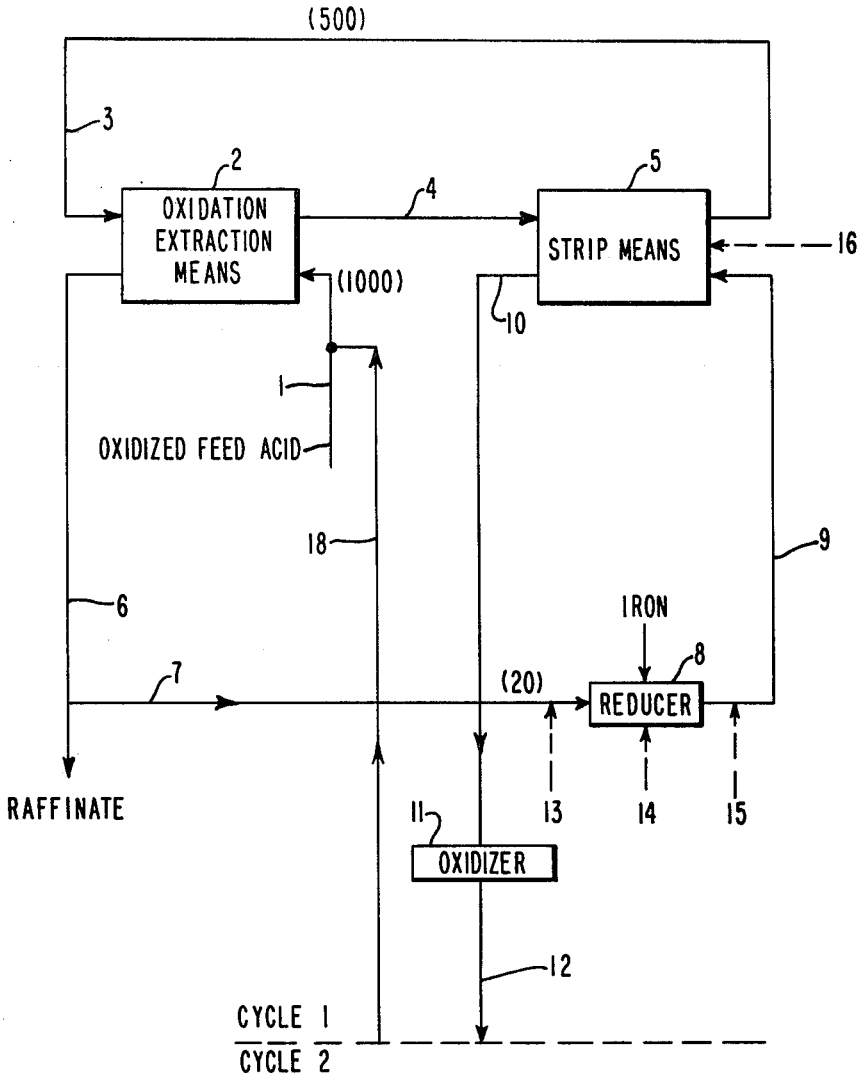
(500)
3
2
OXIDATION EXTRACTION MEANS
4
5
STRIP MEANS
16
(1000)
10
1
OXIDIZED FEED ACID
18
9
6
IRON
8
7
(20)
REDUCER
RAFFINATE
11
13
14
15
OXIDIZER
12
CYCLE 1
CYCLE 2

METHOD OF INCREASING THE STRIP COEFFICIENT OF THE STRIP SOLUTION STREAM IN A REDUCTIVE STRIPPING URANIUM RECOVERY OPERATION

BACKGROUND OF THE INVENTION

Uranium can be recovered from commercial grade wet process phosphoric acid by an oxidative extraction-reductive stripping process. In this process, an oxidized phophoric acid solution is contacted, generally in a multistage, countercurrent extractor, with an organic extractant solvent composition having an affinity for oxidized uranium values. This composition is usually a mixture of di(2-ethylhexyl)phosphoric acid (D2EHPA) and trioctylphosphine oxide (TOPO) in a solvent medium. After extraction, two phases are formed, namely an aqueous acid raffinate phase and an organic phase rich in oxidized uranium values. A small part of the acid raffinate can be contacted with iron and used as a reductive strip solution. Then, the organic phase is stripped of its uranium content, generally in a multistage countercurrent reductive stripper, and the stripped organic solvent is returned to the extraction system.

This stripping is enhanced, in the first cycle of the process, by the reduction of the uranium to the +4 state during the stripping with a reduced strip acid solution containing a high concentration of ferrous iron, +2 state. Elemental iron has been used to reduce the aqueous acid raffinate strip solution and provide the desired concentration of ferrous ion. This reductive stripping is taught by Hurst et al., in U.S. Pat. No. 3,711,591. The pregnant aqueous stripping solution exiting the reductive stripper is then again oxidized after which it is fed into the second cycle of the uranium recovery process. In the second cycle, the oxidized uranium in the aqueous solution is again extracted into an organic and the organic is cycled to an ammonium carbonate stripping and precipitating stage. An iron ammonium-phosphate precipitate is sometimes formed in the second cycle extractor. Wiewiorowski et al., in U.S. Pat. No. 4,105,741, eliminated this precipitate, which interferes with uranium recovery, by washing the second cycle solvent, after exiting the second cycle stripper, with an outside stream of a purified acid selected from sulfuric, hydrochloric, nitric or iron-free phosphoric acid.

We have found that one of the factors affecting operation, and particularly the efficiency of the reductive stripping operation, is the lowering of the phosphoric acid concentration in the reduced acid strip solution fed into the first cycle reductive stripper. This has a deteriorative effect on the strip coefficient, and the eventual recovery of uranium. A major cause of the lowered concentration is believed to be water contamination from rain water and from pump seals and line or vessel cleaning. One solution has been to purge the first cycle circuit of the low $P_2O_5$ strip solution. However, this generally requires a 48 to 72 hour period, during which time a considerable quantity of uranium will be lost. Another solution is to further increase the iron addition to increase the ferrous ion concentration in the reductive stripping solution. However, this increases the precipitation of iron ammonium-phosphates in the reductive stripper and in the second cycle extractor, necessitating more frequent shutdowns to remove the precipitates. What is needed is an inexpensive, on stream method to increase the strip coefficient of low $P_2O_5$ strip solution, not requiring costly downtime.

SUMMARY OF THE INVENTION

The above problem has been solved and the above need met by adding sulfuric acid, preferably in concentrated form to the strip solution. Concentrated $H_2SO_4$ can be fed into the strip solution, especially when the $P_2O_5$ concentration is low, before the iron reduction stage, during the iron reduction stage, after the iron reduction stage but before the stripping stage, or into the stripping stage, i.e. any time before it exits the stripping means.

Preferably, the stripping operation is then carried out at a temperature of between about 35° C. and 50° C. Such $H_2SO_4$ addition has been found to increase the strip coefficient of low $P_2O_5$ strip solution by up to 58%, resulting in a 3.5% total increase in uranium recovery. Such $H_2SO_4$ addition decreases the precipitation of phosphates and does not harm the extraction coefficient of the solvent that the strip solution contacts in the reductive stripper.

BRIEF DESCRIPTION OF THE DRAWING

For a better description of the invention, reference may be made to the preferred embodiments exemplary of the invention and shown in the accompanying drawing, which is a flow diagram illustrating a presently preferred process according to this invention. Typical flow rates are given in the drawings in brackets and may be taken as gal./hr., gal./min., etc.

DESCRIPTION OF THE PREFERRED EMBODIMENTS

Referring to the drawing, in the first cycle of the uranium recovery process, the wet-process phosphoric acid feed 1 is clarified and fed into a multistage extraction system 2. The feed is typically a hot aqueous solution of phosphoric acid having a pH of up to about 1, and containing about 0.1 to about 0.5 gram/liter of uranium, as the oxidized uranyl ion, $UO_2^{+2}$. In the extractor 2, the feed acid is mixed with a water-immiscible, organic solvent containing reagents which extract the uranyl ions into the solvent. Typically, the organic is kerosine in a 0.1 to 10 feed acid to solvent ratio, by volume. The kerosine contains about 0.1 to 1 mole/liter of di-2-ethylhexyl phosphoric acid (D2EHPA) and about 0.025 to about 0.25 mole/liter of tri-n-octylphosphine oxide (TOPO). As shown in line 18, feeding acid from the extractor in the second cycle of the process.

The pregnant organic, containing the oxidized uranium, passes through line 4 to reductive stripper 5. A portion of the wet process acid raffinate 6 from extractor 2 passes through line 7 on its way to be used as a strip solution stream in reductive stripper 5. The raffinate will be contacted with iron at reducer 8, where iron (Fe°) is added to bring the ferrous ion concentration up to a concentration sufficient to reduce the uranyl ion in the organic to the $U^{+4}$ ion. The ferrous ion in the reductive stripper 5 is oxidized to the ferric ion as it reduces the uranyl ion to the quadravalent $U^{+4}$ ion. While other reducing ions may be used to reduce the uranium to the $U^{+4}$ ion, the ferrous ion is preferred because of its low cost. The $U^{+4}$ ion enters the aqueous stream in line 10. The ratio of line 4 solvent:raffinate in line 9 is typically about 40 to 50:1. The barren organic solvent leaving the stripper is then recycled through line 3 to extractor 2. The $U^{+4}$ in the product acid of line 10 is oxidized to the uranyl ion in oxidizer 11, to enable the uranium to be extracted again in Cycle 2. The product from Cycle 1 typically has a pH of about 1 and contains about 25 to 40 grams/liter iron and about 5 to 15 grams/liter uranium.

In the process of this invention, the strip solution in line 7, may have a lowered $P_2O_5$ concentration due to various factors occurring during first cycle operation, and thus a lowered strip coefficient. Sulfuric acid, preferably in concentrated form, can be fed into the system from either line 13, 14, 15 or 16. The acid can be fed to the strip solution stream at any time before it exits the stripping means, that is, before the iron reduction stage, line 13, after the iron reduction stage but before the stripping stage, line 15, during the stripping stage 16, or preferably, in the reducer 8, through line 14. The reducer 18 will generally comprise a reducing cone generally containing scrap iron, preferably in elemental form.

The concentrated (preferably about 98%) $H_2SO_4$ is added to the low $P_2O_5$ strip solution at least once, in an amount effective to provide, for a given flow of strip solution, an $H_2SO_4$ acid concentration of preferably between about 5 wt.% and about 15 wt.%, and most preferably between about 9 wt.% and about 12 wt.%. Any amount of $H_2SO_4$ however will be effective to some degree. For example, in the process of this invention, each gallon of strip solution to be acidified, will preferably have added thereto from about 5 wt.% to about 15 wt.% of concentrated acid, based on strip solution plus concentrated acid. Less than 5 wt.% concentrated additive acid addition provides a relatively small improvement to the strip coefficient of the strip solution. Over 15 wt.% concentrated additive acid addition results in corrosion of the fiber reinforced plastic piping that is generally used with phosphoric acid processes and also results in a reduction of the strip coefficient. In volume terms, approximately 5 wt.% to 15 wt.% addition of concentrated acid would be equivalent to approximately 0.75 gal. to 2.8 gal. of concentrated additive acid/min. per 20 gal./min. of low $P_2O_5$ strip solution. Concentrated sulfuric acid is preferred because the addition of dilute acid would further contribute water and further dilute the stripping solution.

The strip coefficient, $S_o$, is herein defined as the concentration of uranium in the product acid exiting the stripper (grams/liter)/the concentration of barren solvent exiting the stripper (grams/liter). Initial laboratory values of $S_o$, when there is a high $P_2O_5$ strip solution are about 9 to 11. After continuous operation of the system, $S_o$ can fall to between about 4 and 5. Preferably, after an effective amount of additive acid addition, the stripping operation is carried out at a temperature of between about 35° C. and about 50° C., providing an optimal increase in the strip coefficient of the strip solution.

EXAMPLE

In an operation similar to that shown in the Drawing, hot, commercial grade wet-process, aqueous, phosphoric acid (30% $P_2O_5$; sp.gr.=1.36), containing about 0.2 gram/liter of uranium and about 10 grams/liter of iron was clarified and fed into an extractor. In the extractor, uranium values were extracted into a water-immiscible, organic extractant composition containing 0.5 mole of di-2-ethylhexyl phosphoric acid (D2EHPA) and 0.125 mole of tri-n-octylphosphine oxide per 1 liter of kerosine.

The organic extractant, containing oxidized uranium values was passed from the extractor to a reductive stripper system at about 40° C., to allow stripping of uranium values from the solvent into a portion of the acid raffinate. The raffinate was from the first cycle extractor and had been reduced by elemental iron in a reducer. The system was run for an extended period of time, to provide reduced, low $P_2O_5$ strip solution in line 9 having a $S_o$ value of about 4 to 5, and then several samples of low $P_2O_5$ strip solution from line 9 were taken for addition to samples of pregnant solvent taken from line 4. Strip sample 1 contained no added sulfuric acid. Strip samples 2, 3 and 4 had added thereto 5 wt.%. 10 wt.% and 15 wt.% respectively of concentrated (98%) $H_2SO_4$. All four strip samples were mixed in large glass beakers with samples of the same aged pregnant solvent, at a ratio of 9 parts solvent to 1 part strip solution by volume, at 43° C. for 20 minutes. This provided product acid and barren solvent which were then separated.

Samples of all the solvent and strip solutions were analyzed for uranium, iron and $P_2O_5$, and then the strip coefficients $S_o$ were determined, as shown in Table I:

TABLE 1*

| Strip Sol. Sample | Strip Acid Solution % $P_2O_5$ | $Fe^{+2}$ (g/l) | $Fe^{+3}$ (g/l) | U (g/l) | % $H_2SO_4$ | Preg. Solvent U (g/l) | Product Acid U (g/l) | $Fe^{+2}$ (g/l) | $Fe^{+3}$ (g/l) | Barren Solvent U | $S_o$ |
|---|---|---|---|---|---|---|---|---|---|---|---|
| 1(Control) | 23.84 | 23.0 | 3.3 | 0.123 | 0 | 0.399 | 1.355 | 17.6 | 8.1 | 0.306 | 4.42 |
| 2 | 22.62 | 22.5 | 2.5 | 0.121 | 5 | 0.399 | 1.580 | 18.4 | 7.5 | 0.288 | 5.49 |
| 3 | 21.62 | 21.0 | 3.0 | 0.121 | 10 | 0.399 | 1.715 | 20.1 | 5.7 | 0.245 | 7.00 |
| 4 | 20.72 | 20.8 | 2.9 | 0.118 | 15 | 0.399 | 1.575 | 19.7 | 7.0 | 0.247 | 6.38 |

NOTE:
*$P_2O_5$ and $H_2SO_4$ concentrations are percent by weight; uranium and iron concentration are grams/liter.

As can be seen from Table I, a significant increase in the strip coefficient can be achieved even with a low $P_2O_5$ concentration in the strip solution by the addition of from about 5 wt.% to about 15 wt.% $H_2SO_4$. Samples 1 and 3 have nearly identical $Fe^{+2}/Fe^{+3}$ ratios, and with 2.2% less $P_2O_5$ in Sample 3, that strip coefficient was still 58% higher than in the Sample 1 control with 0 wt.% $H_2SO_4$. Use of other concentrated acids may corrode or contaminate equipment.

We claim:

1. In the method of recovering uranium from wet process phosphoric acid, where, in the first cycle, wet process phosphoric acid feed solution is passed through an extraction means to provide a uranium rich solvent stream containing dialkylphosphoric acid and trialkylphosphine oxide extractants, and a raffinate acid stream, wherein the uranium rich solvent stream is passed through a reductive stripping means and a portion of the raffinate acid to be used as a strip solution stream is passed through a reductive stripping means to contact the uranium rich solvent, said strip solution after exiting the reductive stripping means being oxidized and fed into a second cycle of the process to recover uranium; the improvement comprising adding sulfuric acid, at least once in the first cycle of the process, to the strip solution stream before the strip solution exits the reductive stripping means, said acid being added in an amount effective to increase the strip coefficient value of the strip solution.

2. The method of claim 1, where the additive acid is concentrated, and the additive acid is added in an amount effective to provide, for a given volume of acidified strip solution, an additive acid concentration of between about 5 wt.% and about 15 wt.%.

3. The method of claim 1, where the uranium rich solvent stream comprises a mixture of di(2-ethylhexyl) phosphoric acid and trioctylphosphine oxide in a solvent medium.

4. The method of claim 1, where iron is also added to the strip solution.

5. The method of claim 1, where the strip solution is contacted with additive acid and iron in a separate reducer means before entering the reductive stripping means.

6. The method of claim 1, where the strip solution stream is a low $P_2O_5$ acid solution.

7. The method of claim 6, where the reductive stripping is carred out at a temperature of between about 35° C. and 50° C.

8. The method of claim 6, where the additive acid is 98% concentrated sulfuric acid.

9. The method of claim 8, where the additive acid is added in an amount effective to provide an additive acid concentration of between 9 wt.% and about 12 wt.%.

10. In the method of recovering uranium from wet process phosphoric acid, where, in the first cycle, wet process phosphoric acid feed solution is passed through an extraction means to provide a uranium rich solvent stream comprising a mixture of di(2-ethylhexyl)phosphoric acid and trioctylphosphine oxide in a solvent medium, and a raffinate acid stream, wherein the uranium rich solvent stream is passed through a reductive stripping means and a portion of the raffinate acid to be used as a strip solution stream is passed through a reductive stripping means to contact the uranium rich solvent, said strip solution after exiting the reductive stripping means being oxidized and fed into a second cycle of the process to recover uranium; the improvement comprising adding sulfuric acid, at least once in the first cycle of the process, to the strip solution stream before the strip solution exits the reductive stripping means, said acid being added in an amount effective to increase the strip coefficient value of the strip solution.

11. The method of claim 10, where the strip solution stream is a low $P_2O_5$ acid solution.

* * * * *